US007587853B2

(12) United States Patent
Aalto

(10) Patent No.: US 7,587,853 B2
(45) Date of Patent: Sep. 15, 2009

(54) SYSTEM FOR FASTENING THE BARREL OF A RIFLE HAVING A REPLACEABLE BARREL

(75) Inventor: Juha Aalto, Riihimäki (FI)

(73) Assignee: Sako Oy, Riihimaki (FI)

( * ) Notice: Subject to any disclaimer, the term of this patent is extended or adjusted under 35 U.S.C. 154(b) by 0 days.

(21) Appl. No.: 10/588,988

(22) PCT Filed: Feb. 10, 2005

(86) PCT No.: PCT/FI2005/050021

§ 371 (c)(1),
(2), (4) Date: Jun. 18, 2007

(87) PCT Pub. No.: WO2005/075930

PCT Pub. Date: Aug. 18, 2005

(65) Prior Publication Data

US 2008/0066361 A1 Mar. 20, 2008

(30) Foreign Application Priority Data

Feb. 10, 2004 (FI) ..... 20040200

(51) Int. Cl.
*F41A 21/00* (2006.01)

(52) U.S. Cl. ..... 42/76.01; 42/75.01

(58) Field of Classification Search ..... 42/75.01, 42/76.01

See application file for complete search history.

(56) References Cited

U.S. PATENT DOCUMENTS

| | | | | | |
|---|---|---|---|---|---|
| 1,363,262 | A * | 12/1920 | North | 89/193 |
| 4,519,156 | A * | 5/1985 | Shaw | 42/77 |
| 4,729,186 | A * | 3/1988 | Rieger | 42/75.04 |
| 4,779,370 | A * | 10/1988 | Cormack | 42/124 |
| 4,989,359 | A * | 2/1991 | Kinkner et al. | 42/77 |
| 2002/0078616 | A1 * | 6/2002 | Perry et al. | 42/76.01 |
| 2006/0026883 | A1 * | 2/2006 | Hochstrate et al. | 42/75.01 |
| 2007/0186458 | A1 * | 8/2007 | Wait | 42/75.02 |

FOREIGN PATENT DOCUMENTS

| | | |
|---|---|---|
| GB | 586495 | 3/1947 |

* cited by examiner

*Primary Examiner*—Michael Carone
*Assistant Examiner*—Samir Abdosh
(74) *Attorney, Agent, or Firm*—Buchanan Ingersoll & Rooney PC

(57) ABSTRACT

A system for fastening the barrel (1) of a rifle with a replaceable barrel, the system consisting of a lock frame (2), into which the barrel socket (5) can be inserted into position and locked by a bolting device. The bolting device consists of a barrel block stop (4) provided at the top of the lock frame (2), a groove (6) in the barrel socket being insertable into the block stop when the barrel is clamped into locked position.

7 Claims, 2 Drawing Sheets

SYSTEM FOR FASTENING THE BARREL OF A RIFLE HAVING A REPLACEABLE BARREL

This invention relates to a system for fastening the barrel of a rifle with a replaceable barrel, the system consisting of a lock frame, into which the barrel socket can be inserted into position and locked by a bolting device.

Practice has shown that it is desirable to replace the barrel of hunting guns for different purposes and calibres. Low-calibre guns, such as small-bore rifles in particular, comprising three different cartridges, 22 LR, 22 Win.Mag and the relatively recently launched model 17 HMR, lead to a need for using all of these in the same gun.

In prior art, the barrels are clamped into a split lock frame around the barrel socket by means of two or more clamping screws. The purpose of this invention is to provide a new type of system for fastening the barrel of a rifle with replaceable barrel, which is characterised by the bolting device comprising a barrel block stop in the top of the locking frame, a groove in the barrel socket being insertable into this stop when the barrel is clamped into locking position.

Various embodiments of the invention are described in the dependent claims of the set of claims.

The invention allows for rapid, reliable and simple replacement of the barrel of a rifle with the desired calibre barrel. Should the barrel for some reason fail to settle in the correct place, the operating system of the gun becomes inoperative. The bolt lock and the cartridge extractor should necessarily settle correctly, and this happens on the sole condition that the barrel has been correctly clamped in position.

Figures 1, 2, 3:
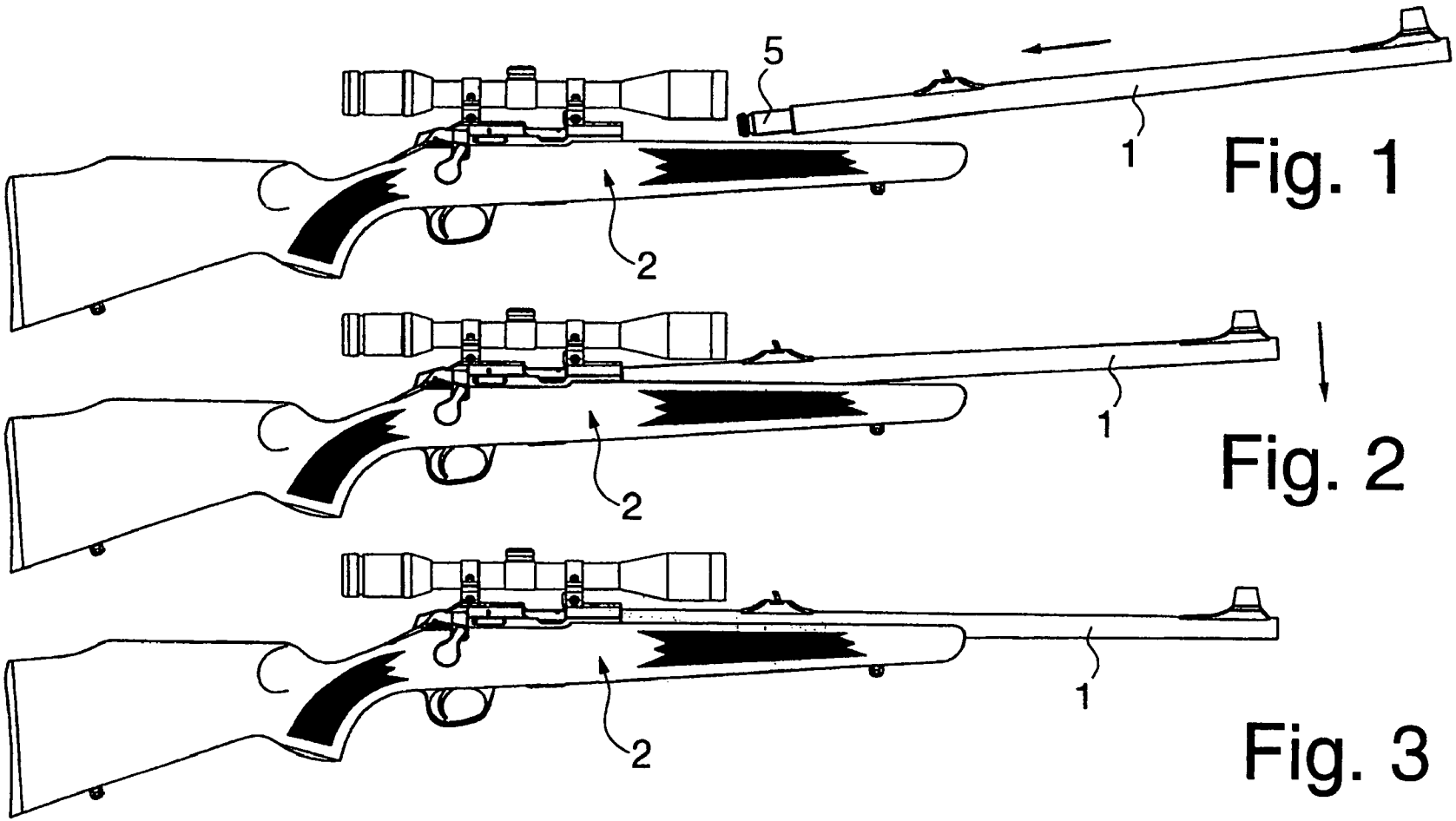
Figure 4:
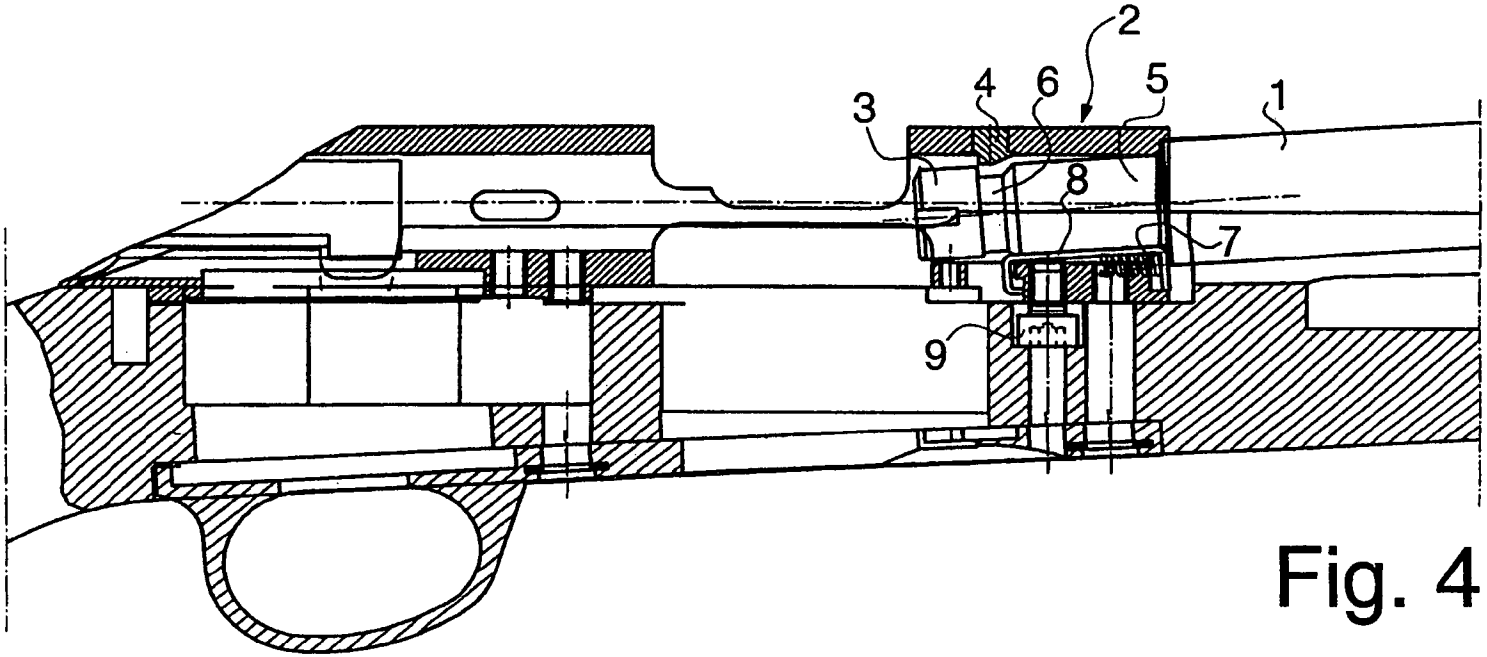
Figure 5:
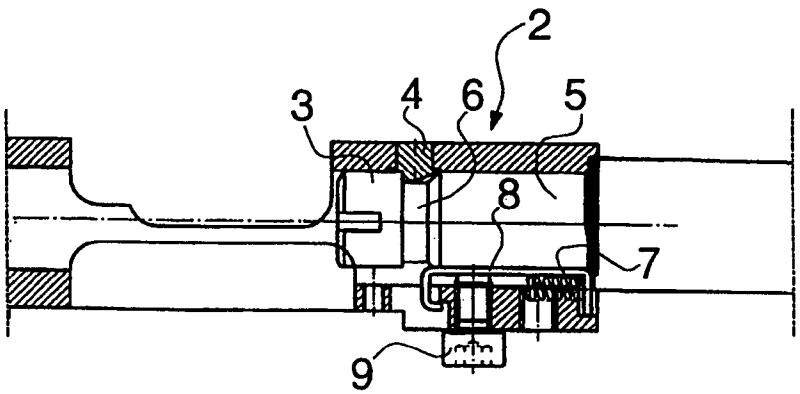

The invention is explained by means of an example below, with reference to the accompanying drawings, in which FIGS. 1, 2 and 3 illustrate the installation of the barrel in the gun, FIG. 4 illustrates the same as FIG. 2, being a partial enlargement and section of the lock frame, and FIG. 5 shows a part of FIG. 4 with the barrel in locked position.

The system for fastening the barrel 1 comprises a lock frame 2, into which the barrel socket 5 can be inserted into position and locked by a bolting device. The bolting device comprises a stop 4 for blocking the barrel 1 provided at the top of the lock frame 2, a groove 6 in the barrel socket 5 being insertable into the stop when the barrel is clamped into locking position. The block stop 4 is a separate tempered arcuate claw fastened to the lock frame 2. The arcuate portion fits into the groove 6 provided in the socket 5 of the barrel 1 in the locked position, being prevented from moving forwardly. On the opposite side of the block stop 4, the lock frame 2 comprises a spring-loaded 7 support plate 9, under which a screw 9 is provided for clamping the socket 5 of the barrel in the lock frame upwardly against the block stop 4. The opening of the lock frame 2 is shaped so as to allow the barrel socket 5 to be pushed into the lock frame 2 at a small angle, with the flange portion 3 of the groove in the barrel socket being allowed to pass by the block stop before the barrel is clamped into position. The lower side of the barrel socket 5, which bears against the support plate 8, has been worked to a planar surface, so that he barrel settles at the correct angle around its axis during installation and clamping. The compression force exerted on the barrel socket will also be more regular when the locking screw 9 is tightened. One single tool, such as an ordinary hex key, is needed for the replacement of the barrel.

The invention claimed is:

1. A system for fastening a replaceable barrel onto a rifle, the system comprising:

a lock frame having an opening into which a barrel socket can be pushed into position and locked with a bolting device, wherein the bolting device comprises a barrel block stop provided within the lock frame, and a groove in the socket of the barrel into which groove the barrel block stop is inserted when the barrel is clamped into locked position, a screw is provided for clamping the socket of the barrel in the lock frame against the barrel block stop; and on a side of the lock frame opposite the barrel block stop, the lock frame comprises a spring-loaded support plate, under which support plate, the screw is provided, and the screw is tightened from an underside of the gun for clamping the socket of the barrel in the lock frame upwardly against the barrel block stop.

2. A fastening system as defined in claim 1, wherein the barrel block stop is a separate tempered arcuate claw, which is fastened within the lock frame and whose arcuate portion settles in the groove in the barrel socket in locked position.

3. A fastening system as defined in claim 1, wherein the opening in the lock frame has been shaped such that the barrel socket can be pushed into the lock frame at an angle to the assembled portion, with a flange portion of the groove in the barrel socket being allowed to pass by the block stop before the barrel is clamped into position.

4. A fastening system as defined in claim 1, wherein an underside of the socket, which bears against a support plate, has a plane surface so that the barrel settles at a correct angle around its axis during installation and clamping.

5. A fastening system as defined in claim 2, wherein the barrel lock stop defines one extent of a headspace in the barrel.

6. A fastening system as defined in claim 1, wherein the barrel block stop is provided at the top of the lock frame.

7. A fastening system as defined in claim 1, wherein the screw is provided for clamping the socket of the barrel in the lock frame upwardly against the barrel block stop.

* * * * *